US009127415B1

(12) United States Patent
Blackwell

(10) Patent No.: US 9,127,415 B1
(45) Date of Patent: Sep. 8, 2015

(54) ANCHOR POSITIONING FORM WITH DRAINAGE SYSTEM

(71) Applicant: Russell Dean Blackwell, Spartanburg, SC (US)

(72) Inventor: Russell Dean Blackwell, Spartanburg, SC (US)

( * ) Notice: Subject to any disclaimer, the term of this patent is extended or adjusted under 35 U.S.C. 154(b) by 24 days.

(21) Appl. No.: 13/782,175

(22) Filed: Mar. 1, 2013

Related U.S. Application Data

(60) Provisional application No. 61/692,949, filed on Aug. 24, 2012.

(51) Int. Cl.
*E01C 19/50* (2006.01)
*E01C 9/00* (2006.01)
*E01C 23/04* (2006.01)

(52) U.S. Cl.
CPC ..... *E01C 19/504* (2013.01); *E01C 9/00* (2013.01); *E01C 23/04* (2013.01); *E01C 2201/20* (2013.01)

(58) Field of Classification Search
CPC ..... E01C 9/00; E01C 19/50; E01C 19/502; E01C 23/04; E01C 2201/20
USPC ..... 249/2, 83, 90, 91, 93, 94; 52/302.1; 264/317, DIG. 44; 248/499, 500
See application file for complete search history.

(56) References Cited

U.S. PATENT DOCUMENTS

| | | | |
|---|---|---|---|
| 5,004,208 | A | 4/1991 | Domizio |
| 5,400,997 | A | 3/1995 | Payne et al. |
| 5,651,911 | A | 7/1997 | Pennypacker |
| 6,082,700 | A | 7/2000 | Lancelot, III et al. |
| 7,127,859 | B2 | 10/2006 | Domizio |
| 8,613,116 | B1 * | 12/2013 | Wood ..... 4/502 |

* cited by examiner

*Primary Examiner* — Michael Safavi
(74) *Attorney, Agent, or Firm* — Monahan & Company, LLC; Timothy J. Monahan

(57) ABSTRACT

A form is provided for positioning an anchor in a castable material, such as concrete, having a core element defining a volume for creating a recess in the castable material, an anchor having one end positioned inside the core element for engaging a security device, such as a cable or chain, and the anchor having another end extending outside the core element, for fixing the anchor in the castable material, and an elongated drain forming member extending from the bottom of the core element to the ground, for creating a passageway for transporting water that collects in the recess.

19 Claims, 6 Drawing Sheets

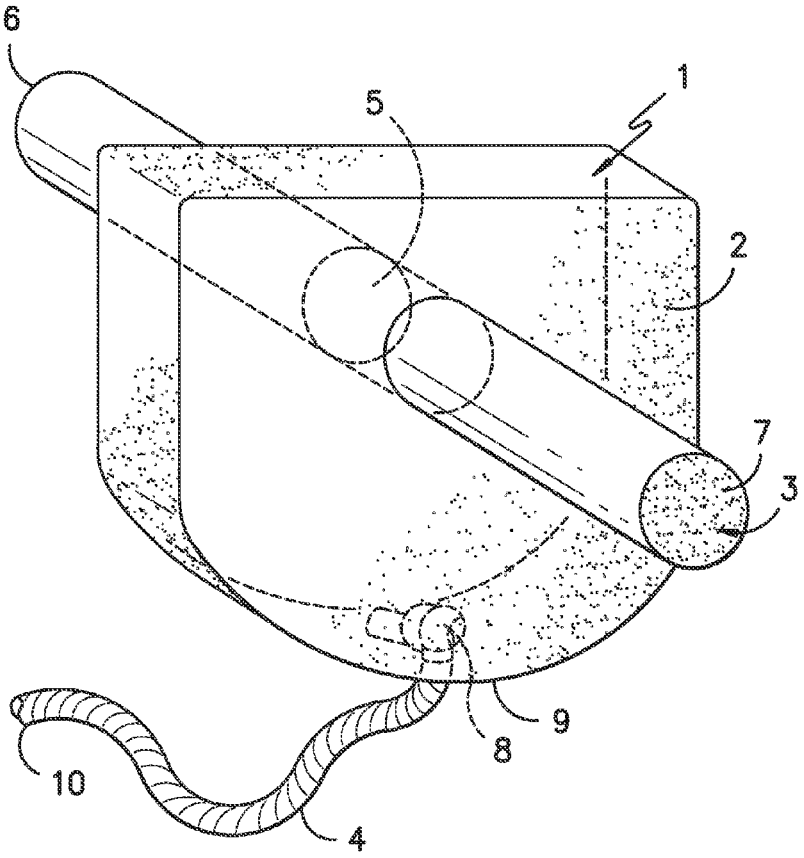
*FIG. —1—*

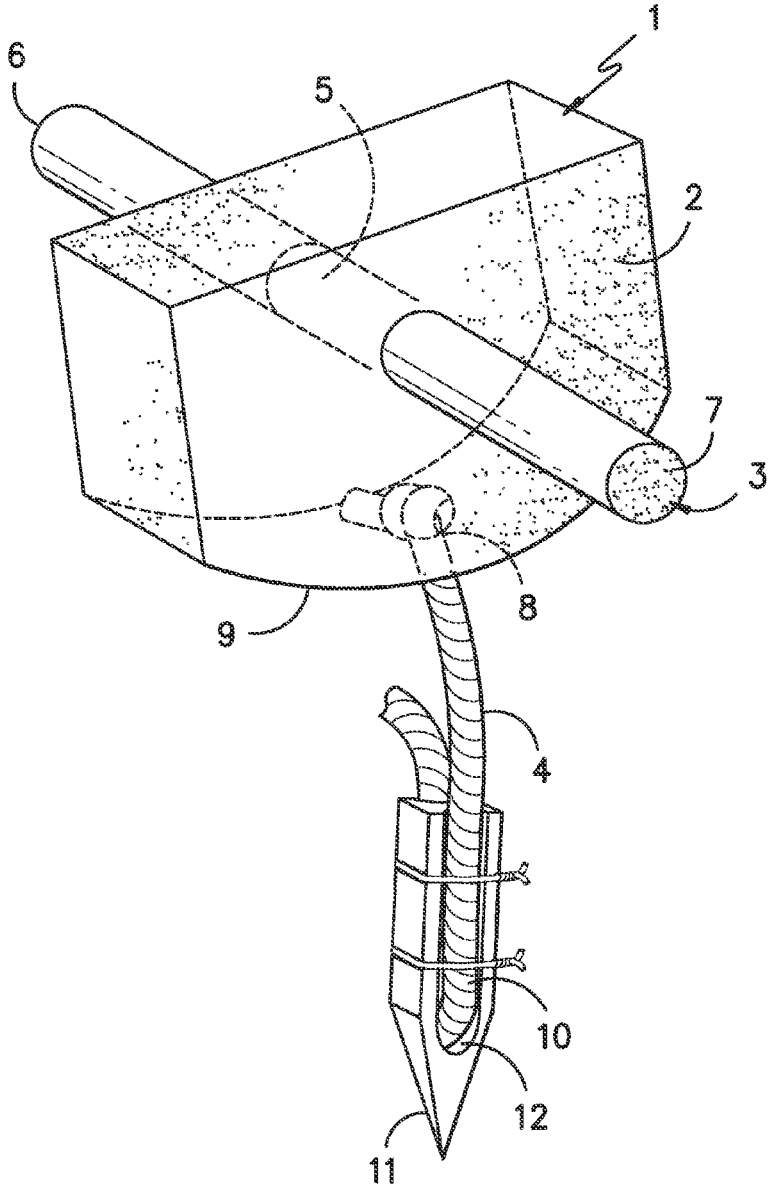
FIG. —2—

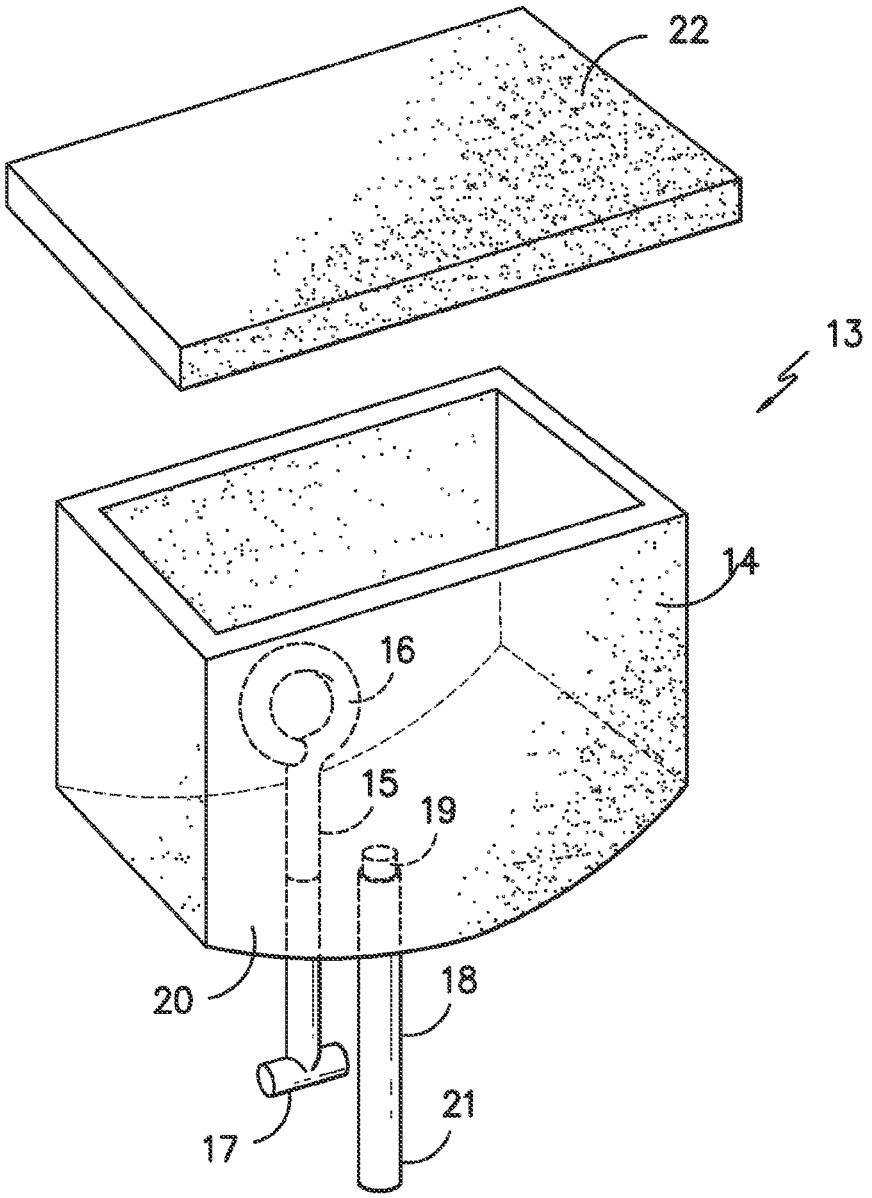
FIG. —3—

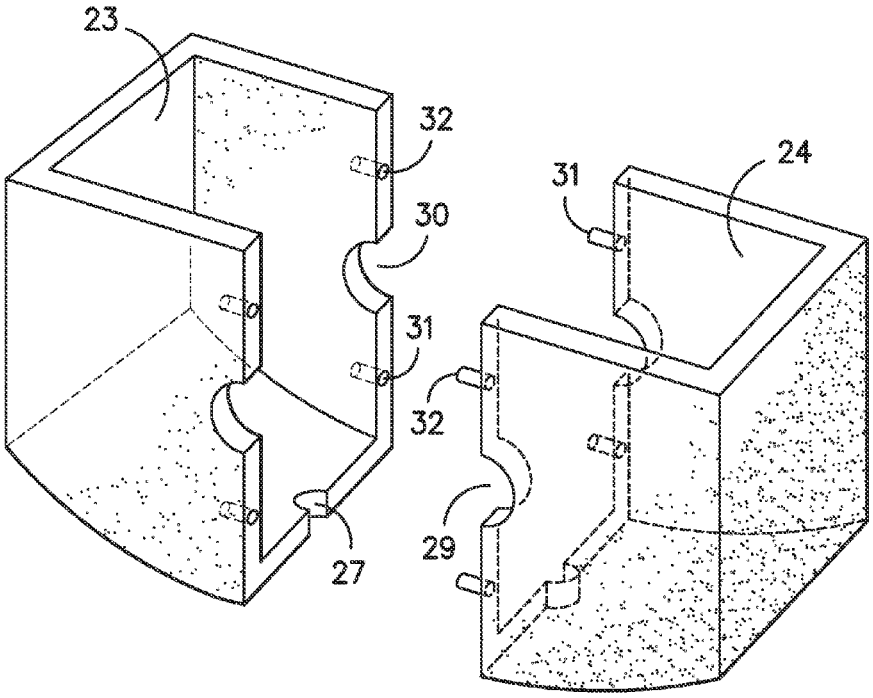
FIG. —4—

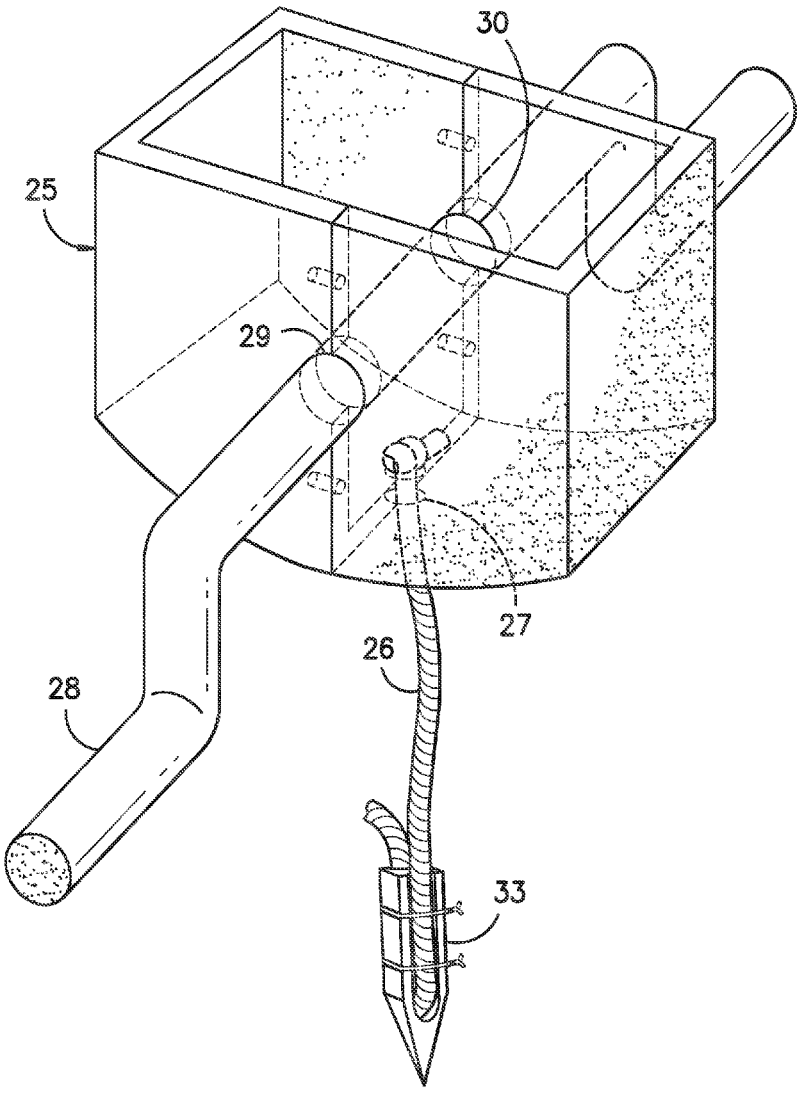
FIG. –5–

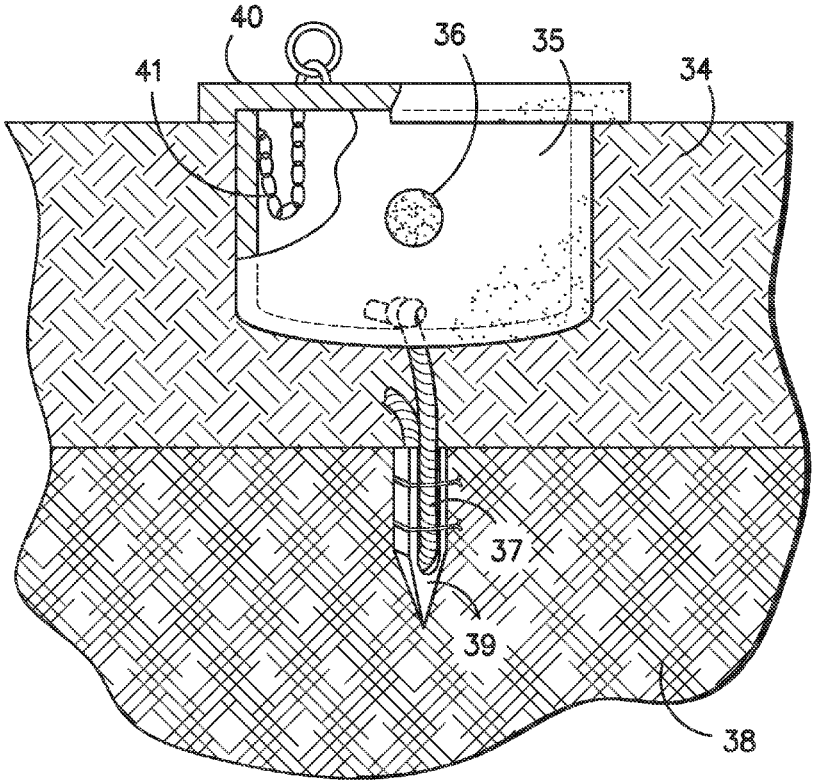
*FIG. —6—*

ANCHOR POSITIONING FORM WITH DRAINAGE SYSTEM

The present invention is directed to a form for positioning an anchor in a recess in concrete, asphalt or other castable material, which also creates a pathway for draining water that would otherwise collect in the recess. The invention is particularly useful for creating a recessed anchor for securing vehicles, trailers and moveable equipment of all kinds in indoor and outdoor environments.

BACKGROUND OF THE INVENTION

Various molds are disclosed for positioning an anchor and forming a recess in a castable material. In a typical example, precast concrete walls are provided with a lifting anchor, so that the concrete unit can be lifted onto a vehicle for transport or moved into position to build a structure. Examples of anchor positioning forms may be found in Domizio—U.S. Pat. No. 5,004,208; Pennypacker—U.S. Pat. No. 5,651,911; Lancelot, III et al.—U.S. Pat. No. 6,082,700; and Domizio—U.S. Pat. No. 7,127,859 B2.

Anchor positioning forms may be used to create a recess in a castable pavement, for securing a valuable article, for example with a chain or cable. A drawback of such systems is that if the pavement is exposed to the elements, water can collect, thereby promoting corrosion of the anchor, chain or cable, as well as providing a site for mosquitoes to breed. Even if the recessed anchor is located indoors, for example in the concrete floor of a garage, shop or warehouse, water used to clean the floor may collect in the recess.

Payne et al.—U.S. Pat. No. 5,400,997 disclose a pre-manufactured anchoring base for posts. The base is intended primarily to be installed flush with finish grade, so that the bottom of the unit extends well into the ground. The base is provided with drain hole 6*f*. A drawback of the base is that when the surrounding soil is saturated, water may enter the drain hole, causing a wooden post to rot or a metal post to corrode. There is no suggestion to integrate the anchoring base into a continuous slab or castable material or to create the anchoring base in situ.

SUMMARY OF THE INVENTION

The subject invention substantially overcomes the aforementioned drawbacks and fills the previously unmet needs. A form for positioning an anchor in a castable material is provided. The form has a core element that defines a volume, which is used to create a recess in the castable material. The form may be reusable or it may be disposable.

The form includes an anchor for engaging a security device, having one portion positioned within the volume defined by the core element, and a second portion extending outside of the volume defined by the core element for fixing the anchor in the castable material. The security device may be a chain or cable for locking up valuable personal property. For example, the anchor may be a straight or U-shaped metal rod, with each end of the rod designed to be positioned in the castable material, or the anchor may be an eyebolt. The portion of the anchor positioned in the recess formed in the castable material may comprise an enlarged head or special configuration intended to be mated with a security device connected to an article to be secured. The anchor may be coated to protect against corrosion, such as by powder coating the anchor with a thermoplastic or thermosetting polymer.

The form includes an elongated drain forming member extending from the bottom of the core element. When the form is positioned in a slab of castable material, the drain forming member creates a passageway through the slab between the recess formed by the core element and the ground below the slab. The drain forming member may be a hollow tube, or it may be a porous material having a structure that is not readily penetrated by the unset castable material. Examples of porous materials include rope made of textile fibers, such as cotton fibers, and open-cell foam. The porous material may be hydrophilic, to act as a wick, to attract and transport water that has collected in the reservoir, to the ground.

If the drain forming member is a flexible, it can be advantageous to fix the end of the member opposite the core element in contact with the ground. For example, the downward end of the drain forming member may be held in contact with the ground by a stake. In one embodiment of the invention, the stake has a hole through it, and the drain forming member is passed through the hole and the stake is planted into the ground. Accordingly, when the form is put in place and the castable material is poured or spread into place to make a slab, the drain forming member is held in the proper position to create a passageway between the recess and the ground, rather than the downward end of the drain forming member being incorporated into the castable material. In an alternative embodiment of the invention, the drain forming member may be a rod that is removed from the castable material, before it completely sets.

The castable material may be concrete, asphalt or a synthetic polymer mixture. Of particular interest is the use of the form to create an anchor in a horizontal slab of the castable material, such as in a driveway, parking lot, sidewalk or airport apron, for securing personal property. Generally, the core element and anchor are proportioned so that the anchor is below grade, that is, below the upper surface of the castable material, so that the anchor does not interfere with traffic on the slab.

In one embodiment of the invention, a cover is provided, which is sized to overlay the recess, and lie approximately flush with the upper surface of the castable material, when the anchor is not being used to secure an article. Alternatively, the cover may be configured as a roof to divert water, especially rainfall, away from the recess.

BRIEF DESCRIPTION OF THE DRAWINGS

FIG. 1 is a perspective view of the form having a solid, frangible core element and a rod anchor.

FIG. 2 is a perspective view of the form having a porous drain forming member and a stake for securing the drain forming member in the ground.

FIG. 3 is a perspective view of a hollow core element having an eyebolt anchor and a tube for a drain forming member.

FIG. 4 is an exploded perspective view of a two-piece form.

FIG. 5 is a perspective view of the two-piece form joined together around an anchor and a rope.

FIG. 6 is a side cutaway view of a slab of concrete with a recess formed therein for an anchor, with a lid to cover the recess when the anchor is not in use.

DETAILED DESCRIPTION OF THE INVENTION

Without intending to limit the scope of the invention, the preferred embodiments and features are hereinafter set forth. All United States patents cited in the specification are incorporated herein by reference.

Referring to FIG. 1, form 1 is comprised of core element 2, an anchor shown as rod 3, and an elongated drain forming member shown as rope 4. Core element 2 defines a volume and is positioned in a castable material before it sets, thereby creating a permanent recess in the castable material after it sets. The present invention may be used with a wide variety of core elements. The core element may be made of a frangible material, such as foamed polystyrene (e.g. Styrofoam®) or clay, which is broken apart and removed after the castable material sets. The core element may be a resilient material, such as polyurethane foam or a natural or synthetic elastomer, which is deformed and/or parted when it is removed from the castable material. Alternatively, the core element may be a rigid or semi-rigid material having an internal cavity, which may remain in the recess formed in the castable material, after the castable material sets.

Core element 2 also functions to support the anchor in a desired orientation. Rod 3 has center section 5, positioned in the interior of core element 2, and ends 6 and 7, extending outside of core element 2. Rod 3 may be provided with a treatment to inhibit corrosion, such as an anodizing process, or rod 3 may be coated, such as by powder coating or paint.

Rope 4 has upper end 8 engaging the bottom 9 of core element 2. Upper end 8 of rope 4 may be positioned within the interior of the volume defined by core element 2, or it may be secured to core element 2, for example, with an adhesive, staple, screw, or tape. Upper end 8 of rope 4 may be knotted, to secure rope 4 after it is threaded through an opening in core element 2. Rope 4 has lower end 10, extending outward from the bottom 9 or core element 2. An objective of the engagement of upper end 8 of rope 4 and bottom 9 of core element 2 is to position upper end 8 at the bottom of the recess formed in a castable material, so that liquid collecting in the recess flows to the drain forming member, or the drain created therefrom. In one embodiment of the invention, bottom 9 of core element 2 is rounded to direct liquid to the hole at the bottom of the recess formed in the castable material by rope 4.

Before pouring the castable material into place, it is important that the lower end 10 of rope 4 is positioned to create a passageway through the castable material, so that water collecting in the recess has a place to go. In most applications, lower end 10 of rope 4 is in communication with the ground. For example, lower end 10 of rope 4 may be buried a few inches in the ground before the castable material is poured. Lower end 10 may be fixed in the ground by various other means, as well. Referring to FIG. 2, lower end 10 may be held in place by stake 11. In one embodiment, stake 11 has hole 12, and rope 4 is threaded through the hole. Stake 11 may be driven into the ground so that rope 4 is in direct contact with the ground.

While the invention is illustrated in FIGS. 1, 2 and 4-6 with a rope, the drain forming member may be selected from a wide range of materials, in keeping with the objectives of the invention. The drain forming member may be selected from material formed into a porous, elongated structure. The porous material may be an open-cell foam. The porous material may be a formed from natural or synthetic fibers, or combinations thereof. The fibers may be continuous filament fibers or staple fibers, or combinations thereof. For example, the porous material may be a woven, non-woven or knitted textile material, such as a strip of fabric. The fibers may be formed into a rope, for example by twisting or braiding the fibers. The term "rope" is intended to include elongated structures of various diameters, including string, twine and yarns. Examples of suitable fibers for forming a rope are those derived from manila hemp, hemp, linen, cotton, coir, jute, straw, flax, ramie, kenaf, rattan, and sisal.

The material of construction of the drain forming member may be selected so that the member will degrade or dissolve, leaving an open passageway from the bottom of the recess to the ground. The material may be biodegradable, such as lyocell, poly(lactic acid), poly(hydroxyalkanoates) and protein based materials, such as soya protein, and alginates, such as seaweed. The material of construction of the drain forming member may be a water soluble polymer, such as polyvinyl alcohol, polyacrylamide, polyacrylic acid, cellulose derived polymers, such as carboxymethyl cellulose, caesin, startches and gelatin. Natural fibers, such as those listed above for forming rope, will also degrade with time in a high moisture environment, leaving an open passageway.

In one embodiment of the invention, the drain forming member is constructed from a hydrophilic, porous material, formed into an elongated structure and referred to generally herein as a "wick." Thus, water that collects at the bottom of the recess is readily transported from the recess downward to the ground. In one embodiment of the invention, the drain forming member is a rope containing a blend of cotton fibers and cold-water soluble polyvinyl alcohol fibers.

The drain forming member may also be a hollow elongated structure, such as a tube. Referring to FIG. 3, form 13 is comprised of hollow, core element 14 supporting eyebolt 15. Core element 14 may be made of a metal or thermoplastic or thermosetting polymer, for example a polyolefin, polyester or polyamide material. The upper end 16 of eyebolt 15 is positioned in the volume defined by core element 14, and the lower end 17 of eyebolt 15 is positioned outside of core element 14, and is able to be fixed in the castable material. The drain forming member of form 13 is tube 18, having upper end 19 engaging the bottom 20 of core element 14. The lower end 21 of tube 18 is designed to extend through the castable material and transport moisture from the recess formed by core element 14 to the ground. Tube 18 may remain in the castable material after it sets, or tube 18 may be withdrawn from the castable material, after the castable material has sufficiently hardened to maintain its shape. If the drain forming member is not intended to remain in the castable material after it sets, the drain forming member may be a solid, elongated material, such as a metal rod, which is withdrawn after the castable material is sufficiently hardened.

Form 13 may be provided with lid 22, which can be placed over core element 14 to exclude castable material when it is poured, or over the recess formed in the castable material, when it is not being used to secure an article, for safety.

A two-piece construction for a hollow form is shown in FIGS. 4 and 5. Sections 23 and 24 are joined together to form core element 25. Rope 26 is inserted through hole 27 in the bottom of core element 25. Anchor 28 is positioned in side holes 29 and 30, prior to sections 23 and 24 being joined. Tabs 31 align with slots 32 to hold core element 25 together. Stake 33 is provided to orient rope 26 in contact with the ground while the castable element is poured.

Referring to FIG. 6, a cross-section view of a slab of castable material 34, having recess 35 formed therein. The present invention is particularly useful in combination with a slab of material having sufficient weight, volume and configuration to be difficult to move, for example, by thieves attempting to steal an article secured to the anchor component of the invention. For example, the slab may be defined as a planar structure made from a castable material, preferably concrete, having a surface area of at least 10 $ft^2$, or a weight of at least 500 lbs. or both. Anchor 36 is a rod extending through recess 35 with each end fixed in the slab. Rope 37 has a knot within the recess and an opposite end positioned in soil 38 by stake 39. Lid 40 covers recess 35, and is retained by chain 41.

Lid 40 is flush with the upper surface of slab 34 or protrudes less than two inches above the surface. Alternatively, the lid covering recess 35 may be a gabled roof (not shown) to divert rainwater away from the recess.

It may be understood that the present invention is useful for securing a wide range of moveable vehicles and equipment, including bicycles, motorcycles, mopeds, ATVs, trailers, boats, tools, tool boxes, ladders, equipment incorporating small engines, such as lawn mowers, snow blowers, air compressors, log splitters, shredders, cement mixers, generators, and farm equipment.

There are, of course, many alternative embodiments and modifications, which are intended to be included within the following claims.

I claim:

1. A form for positioning an anchor in a castable material, comprising:

(a) a core element defining a volume;

(b) an anchor having a first portion positioned within the volume of the core element for engaging a security device and a second portion positioned outside the volume of the core element for fixing the anchor in the castable material; and (c) an elongated drain forming member having a first end engaging a bottom of the core element and a second end extending from the bottom of the core element, wherein the drain forming member is capable of transporting water downward from a void created by the core element in the castable material, and wherein the drain forming member is selected from the group consisting of hollow tubes and porous material.

2. The form of claim 1, wherein the anchor is selected from the group consisting of a rod and an eyebolt.

3. The form of claim 2, wherein the anchor is a rod, and the rod comprises a center positioned within the volume of the core element and first and second ends positioned outside the volume of the core element.

4. The form of claim 1, wherein the drain forming member is a wick comprised of hydrophilic fibers selected from the group consisting of natural and synthetic fibers.

5. The form of claim 4, wherein the wick is a rope.

6. The form of claim 1, wherein the drain forming member is a wick and further comprising a stake engaging the second end of the drain forming member.

7. The form of claim 6, wherein the stake has a hole through it and the second end of the drain forming member is threaded through the hole.

8. The form of claim 1, wherein the drain forming member is a hollow tube.

9. The form of claim 1, wherein the first end of the drain forming member is positioned within the volume defined by the core element.

10. The form of claim 9, wherein the core element has an opening in the bottom and the drain forming member extends through the opening.

11. The form of claim 1, wherein the bottom of the core element is rounded to direct water to the first end of the drain forming member, when the form is positioned in a castable material.

12. The form of claim 1, wherein the anchor is a U-shaped rod.

13. A form for positioning an anchor in a castable material, comprising:

(a) a core element having a bottom and defining a volume capable of creating a recess in the castable material;

(b) an anchor having a first portion positioned within the volume of the core element and above the bottom of the core element, for engaging a security device, and a second portion positioned outside the volume of the core element for fixing the anchor in the castable material; and (c) an elongated drain forming member having a first end in direct contact with the bottom of the core element and a second end extending from the bottom of the core element, wherein the drain forming member is capable of creating a downward passageway in the castable material for transporting water collecting in the recess created by the core element, and wherein the drain forming member is selected from the group consisting of hollow tubes and porous material.

14. The form of claim 13, wherein the first end of the drain forming member is positioned within the volume defined by the core element.

15. The form of claim 13, wherein the core element has an opening in the bottom and the drain forming member extends through the opening.

16. The form of claim 13, wherein the drain forming member is a wick comprised of hydrophilic fibers selected from the group consisting of natural and synthetic fibers.

17. The form of claim 13, wherein the drain forming member is a hollow tube.

18. The form of claim 13, wherein the bottom of the core element is rounded to direct water to the first end of the drain forming member, when the form is positioned in the castable material.

19. The form of claim 13, wherein the drain forming member is a wick and further comprising a stake engaging the second end of the drain forming member.

* * * * *